US009928952B2

(12) United States Patent
Ahn

(10) Patent No.: US 9,928,952 B2
(45) Date of Patent: Mar. 27, 2018

(54) COIL-EMBEDDED INTEGRATED CIRCUIT SUBSTRATE AND METHOD OF MANUFACTURING THE SAME

(71) Applicant: SAMSUNG ELECTRO-MECHANICS CO., LTD., Suwon-Si, Gyeonggi-Do (KR)

(72) Inventor: Jin Mo Ahn, Suwon-Si (KR)

(73) Assignee: SAMSUNG ELECTRO-MECHANICS CO., LTD., Suwon-si, Gyeonggi-Do (KR)

( * ) Notice: Subject to any disclaimer, the term of this patent is extended or adjusted under 35 U.S.C. 154(b) by 78 days.

(21) Appl. No.: 14/946,611

(22) Filed: Nov. 19, 2015

(65) Prior Publication Data

US 2016/0284462 A1 Sep. 29, 2016

(30) Foreign Application Priority Data

Mar. 24, 2015 (KR) ..... 10-2015-0040897

(51) Int. Cl.

| | |
|---|---|
| ***H01F 5/00*** | (2006.01) |
| ***H01F 27/28*** | (2006.01) |
| ***H01F 27/06*** | (2006.01) |
| *H01F 17/04* | (2006.01) |

(52) U.S. Cl.

CPC ..... *H01F 27/06* (2013.01); *H01F 2017/048* (2013.01); *H01F 2027/065* (2013.01)

(58) Field of Classification Search

CPC ..... H01F 5/00; H01F 27/28
USPC ..... 336/200, 232
See application file for complete search history.

(56) References Cited

U.S. PATENT DOCUMENTS

| | | | | |
|---|---|---|---|---|
| 6,713,162 | B2 * | 3/2004 | Takaya | H03H 7/0115 333/184 |
| 7,358,843 | B2 * | 4/2008 | Takayama | H04B 15/02 336/200 |
| 2007/0075817 | A1 * | 4/2007 | Lotfi | H01F 17/04 336/200 |
| 2008/0309442 | A1 * | 12/2008 | Hebert | H01F 27/292 336/65 |
| 2012/0212919 | A1 * | 8/2012 | Mano | H05K 1/185 361/782 |
| 2014/0159851 | A1 * | 6/2014 | Mano | H01F 27/2804 336/200 |

FOREIGN PATENT DOCUMENTS

| | | | |
|---|---|---|---|
| JP | 2014-120566 | A | 6/2014 |
| KR | 10-0765022 | B1 | 10/2007 |
| KR | 10-2012-0095294 | A | 8/2012 |

OTHER PUBLICATIONS

Korean Office Action dated Feb. 2, 2016, issued in corresponding Korean patent application No. 10-2015-0040897. (w/ English translation).

* cited by examiner

*Primary Examiner* — Tsz Chan
(74) *Attorney, Agent, or Firm* — McDermott Will & Emery LLP

(57) ABSTRACT

A coil-embedded integrated circuit substrate includes a core substrate having an at least partially machined space formed herein, a coil disposed in the at least partially machined space, a filling material filling air gaps in a space around the coil in the at least partially machined space, and insulating layers formed on upper and lower surfaces of the core substrate.

10 Claims, 4 Drawing Sheets

COIL-EMBEDDED INTEGRATED CIRCUIT SUBSTRATE AND METHOD OF MANUFACTURING THE SAME

CROSS-REFERENCE TO RELATED APPLICATION

This application claims benefit of priority to Korean Patent Application No. 10-2015-0040897 filed on Mar. 24, 2015, with the Korean Intellectual Property Office, the disclosure of which is incorporated herein in its entirety by reference.

TECHNICAL FIELD

The present disclosure relates to a coil-embedded integrated circuit substrate and a method of manufacturing the same.

BACKGROUND

In accordance with the demand for miniaturized electronic devices having high degrees of performance, high density, high performance electronic components have been developed. Thus, demand for small integrated circuit substrates on which electronic components may be mounted at a high degree of density has been gradually increased. In order to satisfy this demand, a multilayer circuit substrate in which a via electrode formed in a via hole electrically connects wiring patterns formed on different layers or connects electronic components and wiring patterns has been developed.

The multilayer circuit substrate has advantages in that the amount of wires connecting electronic components may be reduced and high density wiring may be implemented. In addition, multilayer circuit substrates have advantages that an area of a surface of an integrated circuit substrate may be increased as well as allowing for excellent electrical characteristics in the electronic components mounted thereon.

Particularly, an embedded integrated circuit substrate into which the electronic components are inserted does not have electronic components mounted thereon, or the like, on the surface thereof, but has electronic components embedded therein. Accordingly, since an embedded integrated circuit substrate having miniaturization, high density, and high performance may be implemented, demand therefor has increased.

SUMMARY

An aspect of the present disclosure may provide a coil-embedded integrated circuit substrate and a method of manufacturing the same, and in detail, may provide a technology capable of adjusting a volume and a capacity of the integrated circuit substrate by allowing a coil to be embedded directly in a core substrate and filling a space around the coil with a filling material.

According to an aspect of the present disclosure, a coil-embedded integrated circuit substrate may include a core substrate in which an at least partially machined space is formed, a coil disposed in the at least partially machined space, a filling material filling air gaps in a space around the coil in the at least partially machined space, and insulating layers formed on upper and lower surfaces of the core substrate.

The coil may be a winding coil embedded in the at least partially machined space. The upper or lower surface of the core substrate may be parallel or perpendicular to a winding direction of the winding coil.

The filling material may contain a magnetic resin composition including a mixture of a metal magnetic powder and a resin.

The metal magnetic powder may contain iron (Fe) as a main component and contain silicon (Si) or chromium (Cr).

The filling material may contain a resin, or a magnetic resin composition including a mixture of a ferrite powder and a resin.

The coil-embedded integrated circuit substrate may further include a via formed by filling a via hole penetrating through the insulating layers with a conductive material, and circuit patterns on the insulating layers connected to the via.

The coil may be connected to the circuit patterns formed on upper and lower layers of the coil by plating or soldering through the via hole, and may be connected to the circuit patterns in at least one direction of upward and downward directions of the filling material in which the coil is embedded.

The coil-embedded integrated circuit substrate may be a substrate having an embedded power inductor for a power management integrated circuit (PMIC).

According to another aspect of the present disclosure, a method of manufacturing a coil-embedded integrated circuit substrate may include forming an at least partially machined space in a core substrate, inserting a coil into the at least partially machined space, filling an air gap in the at least partially machined space with a filling material, and forming insulating layers on upper and lower portions of the core substrate and the filling material.

In the inserting of the coil, a winding coil may be inserted into the at least partially machined space to be parallel or perpendicular with respect to a winding direction.

The forming of the insulating layers may include forming an upper insulating layer on the upper portions of the core substrate and the filling material, filling the lower portion of the filling material with the filling material to embed the coil, and forming a lower insulating layer on the lower portions of the core substrate and the filling material.

The inserting of the coil into the at least partially machined space may include attaching an adhesive film to the lower surface of the core substrate in which the at least partially machined space is formed, and attaching the coil to the adhesive film by inserting the coil into the at least partially machined space, and the adhesive film attached to the lower surface of the core substrate may be removed before the lower insulating layer is formed on the lower surface of the core substrate.

The method of manufacturing a coil-embedded integrated circuit substrate may further include forming a via hole by removing portions of the insulating layers, forming a via by filling the via hole with a conductive material, and forming circuit patterns on the insulating layers to connect to the via.

The coil may be connected to the circuit patterns formed on upper and lower layers of the coil by plating or soldering through the via hole, and may be connected to the circuit patterns in at least one direction of upward and downward directions of the filling material in which the coil is embedded.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1A:
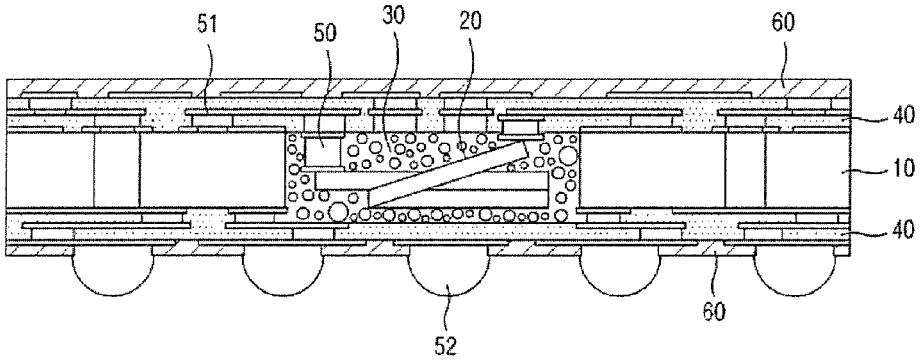
FIGS. 1A and 1B are cross-sectional views schematically illustrating a coil-embedded integrated circuit substrate according to an exemplary embodiment in the present disclosure.

Hereinafter, embodiments of the present disclosure will be described in detail with reference to the accompanying drawings.

The disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Figure 1B:
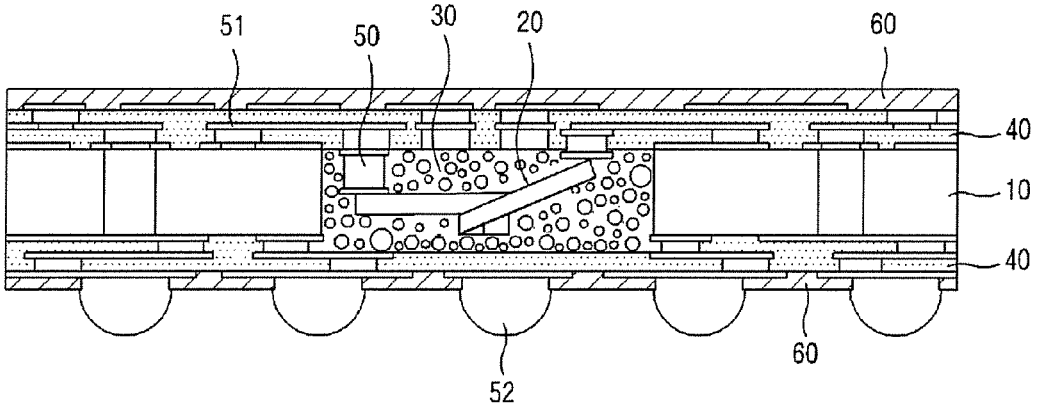

FIGS. 1A and 1B are cross-sectional views schematically illustrating a coil-embedded integrated circuit substrate according to an exemplary embodiment in the present disclosure.

Referring to FIGS. 1A and 1B, a coil-embedded integrated circuit substrate may include a core substrate 10, a coil 20, a filling material 30, and an insulating layer 40.

The core substrate 10 may have an at least partially machined space formed therein, in which the coil, or the like is mounted. At least part of a space of the core substrate 10 may be machined to form a cavity. This machining may be performed by a physical, optical, or chemical means, a size and a shape of the cavity may be variously determined by design requirements and a manufacturing process, and a plurality of cavities may be formed depending on the number of coils to be embedded.

As a material of the core substrate 10, for example, copper clad laminate (CCL), PPG, Ajimoto build-up film (ABF), epoxy, polyimide, or the like, may be used.

For example, metal foil, copper foil, or an internal layer circuit patterns may be formed on an upper portion and a lower portion of the core substrate 10. Alternatively, the internal layer circuit pattern may be formed on at least one of one surface and the other surface of the core substrate 10. For example, the core substrate 10 may also include a through via disposed in a through hole and the internal layer circuit pattern formed on the surface thereof.

The coil 20 may be disposed in the cavity, the at least partially machined space, and a space around the coil 20 is filled with the filling material 30, such that the coil 20 may be stably seated in the cavity. The above-mentioned coil 20 may be formed of a winding coil and may be embedded in the at least partially machined space of the core substrate 10 to so that the surface of the core substrate 10 is parallel (FIG. 1A) or perpendicular (FIG. 1B) to a winding direction, but is not limited thereto.

As a method of embedding the coil 20, for example, an at least partially machined space is formed in a core layer of a printed circuit board (PCB), such that the coil 20 may be seated in the at least partially machined space, or the coil 20 may also be directly attached to the PCB or a circuit formed of copper (Cu) below a coil mounting surface using a solder. A predetermined region around the coil 20 may be filled with one or more filling materials 30 from among a metal magnetic powder, ferrite, a resin, and a magnetic resin composition, so as to be used as a power inductor or a high frequency inductor.

The filling material 30 may fill an air gap in the space around the coil 20 in the at least partially machined space of the core substrate 10. The coil 20 and the core substrate 10 may be disposed to have air gaps formed therebetween, and a space part formed between the coil 20 and the core substrate 10 when the coil 20 and the core substrate 10 are disposed to have the air gaps therebetween may be filled with the filling material 30.

The filling material 30 may be, for example, the magnetic resin composition in which the metal magnetic powder and the resin are mixed. In this case, the metal magnetic powder may contain iron (Fe) as a main component and may contain silicon (Si) or chromium (Cr). The filling material 30 may be, for example, the magnetic resin composition in which the ferrite powder and the resin are mixed. As such, the filling material 30 is filled in the space around the coil 20 embedded using the magnetic resin composition formed by mixing the metal magnetic powder or the ferrite powder with the resin, thereby increasing inductance. As a result, the filling material 30 may serve as the power inductor.

In addition, the filling material 30 may only contain the resin, so as to also function as a high frequency matching inductor.

The filling material 30 may be formed as a sheet and may fill upper and lower portions of the coil 20. In detail, the filling material 30 may be cured after the metal magnetic powder and the resin are formed as a sheet and are laminated and compressed on at least one surface of the coil 20. For example, the filling material 30 may include a material for obtaining high magnetic characteristics and DC-bias of a coil inductor. In detail, as the metal magnetic powder and the resin, a coarse powder or a fine powder containing Fe, Cr, and Si as the main component may be used as the metal magnetic powder, and an epoxy-based resin may be used as the resin. Thereby, a sheet having a predetermined thickness may be formed.

As such, the coil 20 is embedded directly in the core substrate 20, the metal magnetic powder and the resin or a ferrite magnetic material and the resin are filled around the embedded coil 20, and the coil and the circuit are connected by a via 50, such that an inductor mounting area in the integrated circuit substrate may be reduced. In addition, since a shape, a size (area), and a thickness of the coil may be selected without being limited to a standard capacity or size of the inductor as a finished chip by directly mounting a desired coil in the integrated circuit substrate, a degree of design freedom may be increased.

The insulation layers 40 may be each formed on upper and lower portions of the core substrate 10 and the filling material 30. A material of the insulating layer 40 may be a known insulating material used in the substrate and an insulating material for the substrate to be developed in the future may also be used. For example, a pregreg, an Ajimoto build-up film, an epoxy resin, a polyimide resin, or the like may be used, and the insulating layer 40 in which a copper foil is formed on one surface thereof may be laminated on the insulating core substrate 10.

The insulating layers 40 may be formed as a sheet and may be each formed on upper and lower surfaces of the core substrate 10.

At the time of laminating the insulating layers 40, spaces in the upper and lower surfaces of the core substrate 10 may be filled by laminating a semi-cured insulating material and then compressing the laminated semi-cured insulating material, and a laminate thickness of the insulating layer 40 and a shape thereof may also be deformed by adjusting a degree of semi-curing or of compression strength.

The coil-embedded integrated circuit substrate according to the exemplary embodiment in the present disclosure may further include a via 50 formed by filling the via hole penetrating through the insulating layer 40 with a conductive material, and a circuit pattern 51 formed on the insulating layer 40 and connected to the via 50.

The via 50 may be formed to be electrically connected to the coil 20. The via 50 may be formed by filling the via hole penetrating through the insulating layer 40 with the conductive material by a method such as plating, soldering, or the like.

The circuit pattern 51 may be formed on the insulating layer 40 so as to be electrically connected to the vial 50. The circuit pattern 51 may be formed simultaneously with the via 50 by plating, soldering, or the like for forming the via 50. As described above, when the copper foil is formed on the insulating layer 40, the circuit pattern 51 may be formed by removing a portion of the copper foil by an etching.

As such, the coil 20 may be connected to the circuit pattern 51 formed on upper and lower layers thereof by plating or soldering 52 through the via hole, and may be connected to the circuit pattern 51 in at least one direction of upward and downward directions of the filling material 30 in which the coil 20 is embedded.

In addition a solder resist 60 may be further formed on an outer surface of the insulating layer 40 in which the via 50, the circuit pattern 51, and the like are formed. The solder resist 60 may cover a portion of the via 50, the circuit pattern 51, and the like to serve as a film preventing an unwanted connection by the solder, or the like, caused at the time of mounting the components.

Meanwhile, the coil-embedded integrated circuit substrate according to the exemplary embodiment in the present disclosure may be used efficiently when a necessity of embedding components is high because the number of power inductors to be mounted is large and the power inductor is bulky, such as an embedded power inductor in a substrate for a power management IC (PMIC), or the like.

As such, the coil may be embedded directly in the integrated circuit substrate such as the PCB, or the like, the metal magnetic powder and the resin, the ferrite and the resin, or the like are filled around the embedded coil, and the via is formed to connect the coil and the circuit to each other, such that a degree of design freedom of the shape and the capacity of the coil may be improved as compared to a case in which passive components are embedded in a finished chip component form. In addition, the coil-embedded integrated circuit substrate may have a structure suitable for an embedded printed circuit board (PCB) for manufacturing a low profile type IC module.

FIGS. 2 through 10 are cross-sectional views schematically illustrating a method of manufacturing a coil-embedded integrated circuit substrate according to an exemplary embodiment in the present disclosure.

Referring to FIGS. 2 through 10, a method of manufacturing a coil-embedded integrated circuit substrate according to an exemplary embodiment in the present disclosure may include an operation of forming an at least partially machined space in a core substrate, an operation of inserting a coil into the at least partially machined space, an operation of filling an air gap in the at least partially machined space with a filling material, and an operation of forming insulating layers on upper and lower portions of the core substrate and the filling material.

In addition, the operation of forming the insulating layers may include an operation of forming an upper insulating layer on the upper portions of the core substrate and the filling material, an operation of filling the lower portion of the filling material with the filling material to embed the coil, and an operation of forming a lower insulating layer on the core substrate and the filling material.

Hereinafter, the respective operations according to the present exemplary embodiment will be described in more detail with reference to FIGS. 2 through 10.

Figure 2:
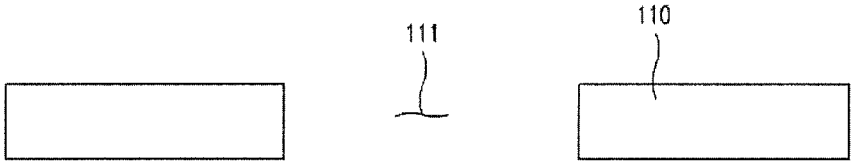
FIGS. 2 through 10 are cross-sectional views schematically illustrating a method of manufacturing a coil-embedded integrated circuit substrate according to an exemplary embodiment in the present disclosure.

Referring to FIG. 2, in the method of manufacturing a coil-embedded integrated circuit substrate according to the exemplary embodiment in the present disclosure, first, an at least partially machined space 111 may be formed in a core substrate 110. At least a partial space in the core substrate 110 may be machined as a cavity. This machining may be performed by physical, optical, or chemical means, a size and a shape of the cavity may be variously determined by design requirements and a manufacturing process.

As a material of the core substrate 110, for example, copper clad laminate (CCL), PPG, Ajimoto build-up film (ABF), epoxy, polyimide, or the like, may be used.

For example, metal foil, copper foil, or an internal layer circuit patterns may be formed on an upper portion and a lower portion of the core substrate 110. Alternatively, the internal layer circuit pattern may be formed on at least one of one surface and the other surface of the core substrate 110. For example, the core substrate 110 may also include a through via filled in a through hole and the internal layer circuit pattern formed on the surface thereof.

Figure 3:
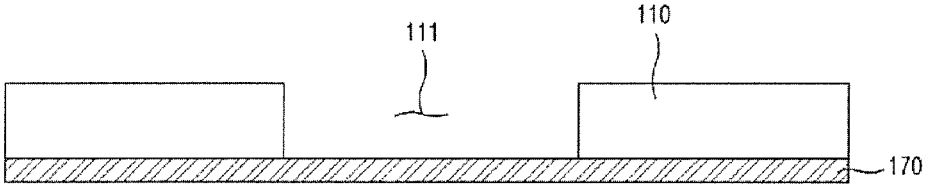

In order to insert and fix a coil 120 into the at least partially machined space 111 of the core substrate 110, as illustrated in FIG. 3, an adhesive film 170 may be attached to the lower surface of the core substrate 110 in which the at least partially machined space 111 is formed.

Figure 4:
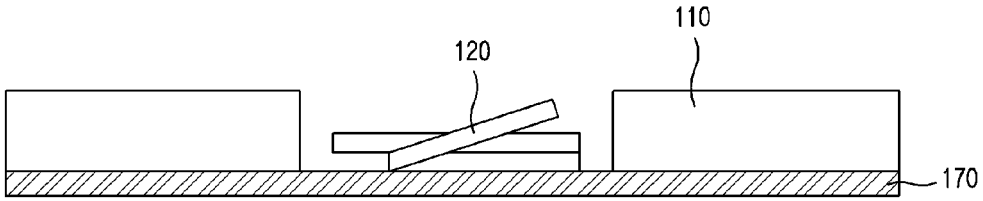

Referring to FIG. 4, the coil 120 may be inserted into the cavity, the at least partially machined space of the core substrate 110.

For example, the coil 120 may be formed of a winding coil and the winding coil may be inserted, along a direction parallel or perpendicular to a winding direction of the winding coil, into the at least partially machined space of the core substrate 110.

When coil 120 is inserted into the least partially machined space 111 of the core substrate 110 and is attached to the adhesive film 170, the coil 120 may be stably seated and fixed, as illustrated in FIG. 4.

Figure 7:
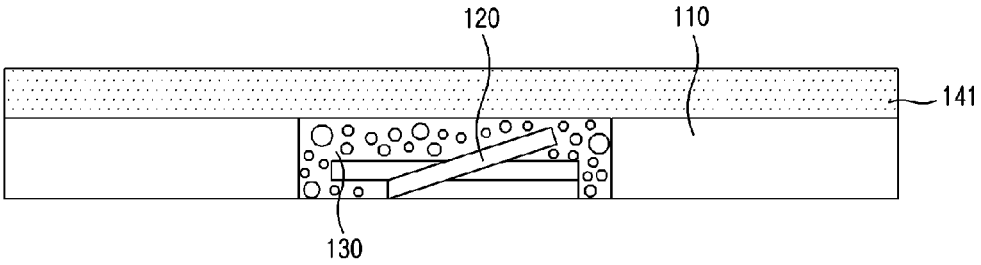

Here, for the attached adhesive film 170, as illustrated in FIG. 7, the adhesive film 170 attached to the lower surface of the core substrate 110 may be removed before the insulating layer 140 is formed on the lower surface of the core substrate 110.

Figure 5:
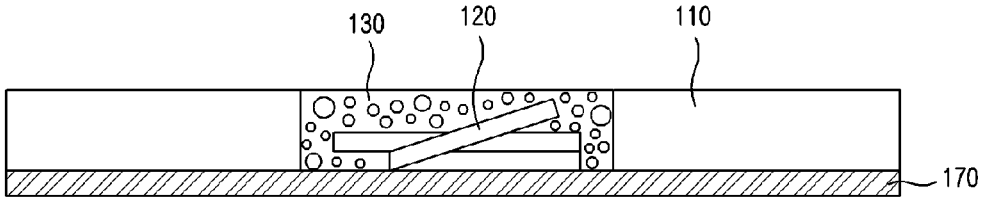

Referring to FIG. 5, an air gap in the at least partially machined space of the core substrate 110 may be filled with the filling material 130 to cover the coil 120. The coil 120 and the core substrate 110 may be disposed to have air gaps formed therebetween, and a space part formed between the coil 120 and the core substrate 110 when the coil 120 and the core substrate 110 are disposed to have the air gaps therebetween may be filled with the filling material 130.

The filling material 130 may be, for example, the magnetic resin composition in which the metal magnetic powder and the resin are mixed. In this case, the metal magnetic powder may contain iron (Fe) as a main component and may contain silicon (Si) or chromium (Cr). For example, the filling material 130 may be formed of the ferrite and the resin to form a shape embedding the coil 120. As such, the filling material 130 is filled in the space around the coil 120 embedded using the magnetic resin composition formed by mixing the metal magnetic powder or the ferrite with the resin, thereby increasing inductance. As a result, the filling material 130 may serve as the power inductor.

In addition, the filling material 130 may only contain the resin, so as to be also used as a high frequency matching inductor.

The filling material 130 may be formed as a sheet and may fill respective upper and lower portions of the coil 120. In detail, the filling material 130 may be cured after the metal magnetic powder and the resin are formed as a sheet and are laminated and compressed on at least one surface of the coil 120. For example, the filling material 130 may include a material for obtaining high magnetic characteristics and DC-bias of a coil inductor. In detail, as the metal magnetic powder and the resin, a coarse powder and a fine powder containing Fe, Cr, and Si as the main component may be used as the metal magnetic powder, and an epoxy-based resin may be used as the resin. Thereby, a sheet having a predetermined thickness may be formed.

As such, a chip may be designed to have a desired shape, a size (area), and a thickness without being limited to a standard capacity or a size of the inductor as a finished chip, by directly mounting a desired coil 120 in the core substrate 110.

In addition, inductance characteristics may be adjusted by freely setting a capacity of the magnetic resin composition such as the metal magnetic powder and the resin, the ferrite magnetic material and the resin, or the like filling the space around the coil, and optimal inductance characteristic such as DC-BIAS, $I_{sat}$ characteristics, or the like may be implemented in a limited substrate or a PCB wire.

Figure 6:
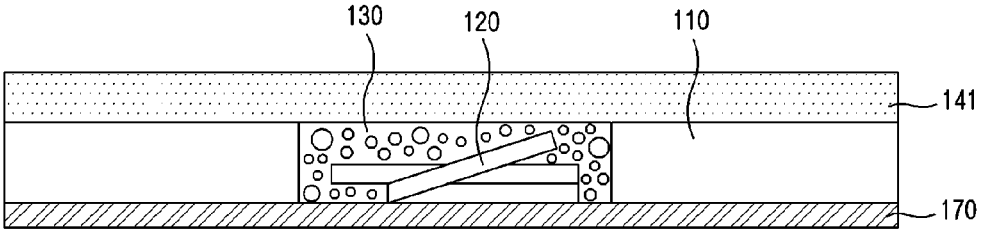
Figure 9:
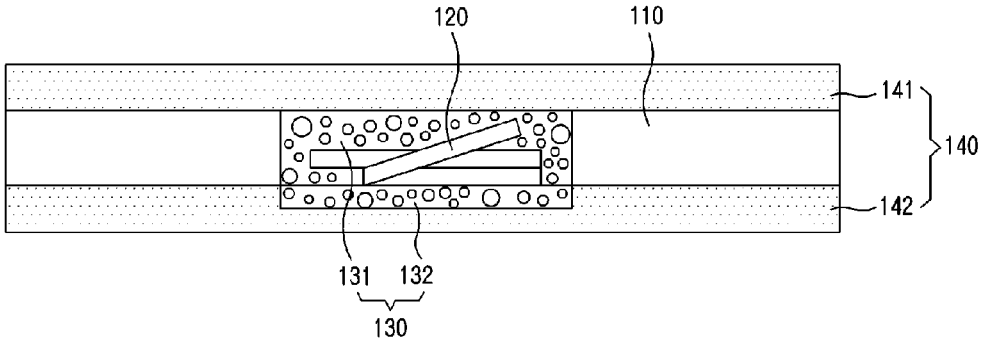

Referring to FIGS. 6 and 9, the insulating layers 140 may be formed on the upper and lower portions of the core substrate 110 and the filling material 130. A material of the insulating layer 140 may be a known insulating material used in the substrate and an insulating material for the substrate to be developed in the future may also be used. For example, a pregreg, an Ajimoto build-up film, an epoxy resin, a polyimide resin, or the like may be used, and the insulating layer 140 in which a copper foil is formed on one surface thereof may be laminated on the insulating core substrate 110.

The insulating layers 140 may be formed as a sheet and may be each formed on the upper and lower surfaces of the core substrate 110.

The insulating layer 140 may be classified as an upper insulating layer 141 and a lower insulating layer 142 that may be sequentially formed. In order to sequentially form the upper insulating layer 141 and the lower insulating layer 142, as illustrated in FIG. 6, the upper insulating layer 141 may first be formed on the upper portions of the core substrate 110 and the filling material 130.

When an adhesive film 170 is attached to the lower surface of the core substrate 110 in order to stably seat and fix the coil 120, after the attached adhesive film 170 is removed, the insulating layer 140 may be formed on the lower surface of the core substrate 110.

Figure 8:
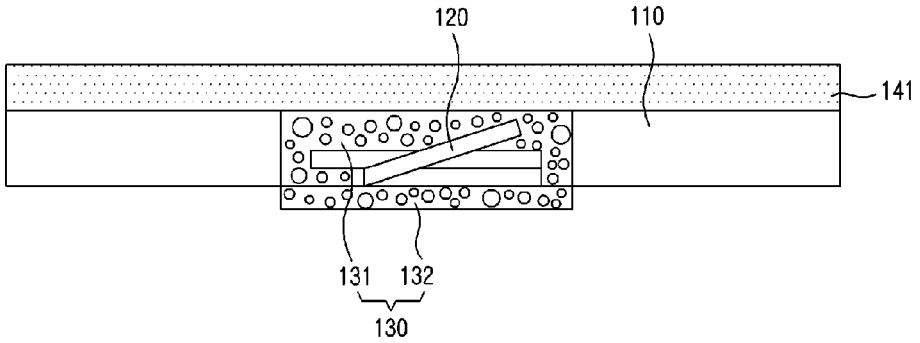

Next, as illustrated in FIG. 8, a filling material 132 is further filled on a lower portion of a filling material 131 to embed the coil 120, such that the space around the coil 120 may be filled with the filling material 130. For instance, the coil 120 may be disposed in the filling material 130.

Referring to FIG. 9, the lower insulating layer 142 is formed on the lower portions of the core substrate 110 and the filling material 130, such that the insulating layers 140 may formed on the upper and lower portions of the core substrate 110 and the filling material 130.

Figure 10:
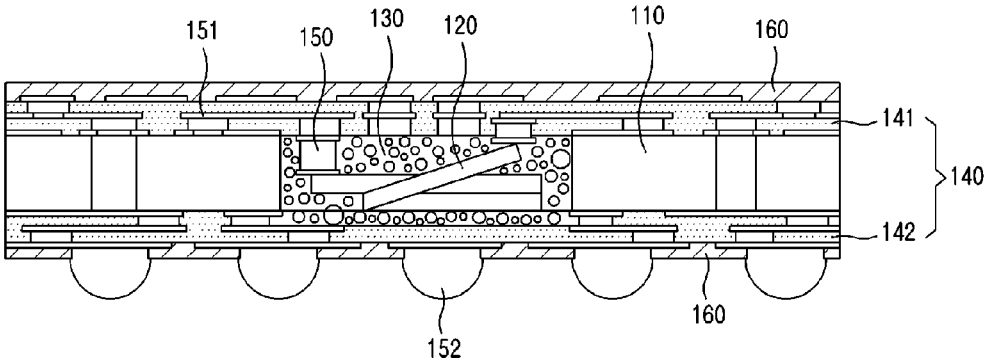

Finally, referring to FIG. 10, a portion of the insulating layer 140 may be removed to form a via hole, and a conductive material may be disposed in the via hole to form a via 150. In addition, a circuit pattern 151 connected to the via 150 is formed on the insulating layer 140, such that the coil 120 and the circuit pattern 151 may be electrically connected to each other through the via 150.

The via 150 may be formed to be electrically connected to the coil 120, and may be formed by filling the via hole penetrating through the insulating layer 140 with the conductive material by a method such as plating, soldering, or the like.

The circuit pattern 151 may be formed on the insulating layer 140 so as to be electrically connected to the vial 150. The circuit pattern 151 may be formed simultaneously with the via 150 by the plating, the soldering, or the like for forming the via 150. As described above, when the copper foil is formed on the insulating layer 140, the circuit pattern 151 may be formed by removing a portion of the copper foil by an etching.

As such, the coil 120 may be connected to the circuit pattern 151 formed on upper and lower layers thereof by plating or solder 152 through the via hole, and may be connected to the circuit pattern 151 in at least one direction of upward and downward directions of the filling material 130 in which the coil 120 is embedded.

In addition, a solder resist 160 may further be formed on an outer surface of the insulating layer 140 in which the via 150, the circuit pattern 151, and the like are formed. The solder resist 160 may cover a portion of the via 150, the circuit pattern 151, and the like to serve to a film preventing an unwanted connection by the solder, or the like, caused at the time of mounting the components.

Meanwhile, the coil-embedded integrated circuit substrate according to the exemplary embodiment in the present disclosure may be efficiently used in a case in which a necessity of embedding the components is high because the number of power inductors to be mounted is large and the power inductor is bulky, such as an embedded power inductor in a substrate for a power management IC (PMIC), or the like.

Further, the coil-embedded integrated circuit substrate and the method of manufacturing the same according to the exemplary embodiments in the present disclosure, which are techniques capable of collectively producing the coil-embedded integrated circuit substrate during a process of manufacturing the PCB of a multilayer circuit substrate, are not schemes in which the finished chip component is embedded, but may be implemented during a PCB multilayer build-up process.

In addition, when the winding coil and the filling of the metal magnetic powder and the resin composition are used in the substrate for the PMIC having a high degree of integration of the power inductor and having a large mounting volume due to the inductor, a size of the substrate may be reduced.

As set forth above, according to the exemplary embodiments in the present disclosure, the coil is embedded directly in the core substrate and the space around the coil is filled with the filling material, whereby the volume and the capacity of the integrated circuit substrate may be selectively adjusted.

While exemplary embodiments have been shown and described above, it will be apparent to those skilled in the art that modifications and variations could be made without departing from the scope of the present invention as defined by the appended claims.

What is claimed is:

1. A coil-embedded integrated circuit substrate comprising:

a core substrate having a through-hole;

an upper insulating layer disposed on an upper surface of the core substrate;

a lower insulating layer disposed on a lower surface of the core substrate opposing the upper surface of the core substrate;

a coil disposed in the through-hole of the core substrate and disposed between a level between the upper surface and the lower surface of the core substrate; and a filling material embedding the coil, and including a first portion filling the through-hole of the core substrate and disposed on the level between the upper surface and the lower surface of the core substrate, and a second portion protruding, in a direction from the upper insulating layer to the lower insulating layer, from the first portion of the filling material and disposed on a level outside the level between the upper surface and the lower surface of the core substrate, wherein the second portion of the filling material separates the coil and the lower insulating layer from each other, and the upper and lower insulating layers are made of a material different from the filling material.

2. The coil-embedded integrated circuit substrate of claim 1, wherein the coil is a winding coil embedded in the through-hole of the core substrate, and the upper or lower surface of the core substrate is parallel to a winding direction of the winding coil.

3. The coil-embedded integrated circuit substrate of claim 1, wherein the coil is a winding coil embedded in the through-hole of the core substrate, and the upper or lower surface of the core substrate is perpendicular to a winding direction of the winding coil.

4. The coil-embedded integrated circuit substrate of claim 1, wherein the filling material contains a magnetic resin composition including a mixture of a metal magnetic powder and a resin.

5. The coil-embedded integrated circuit substrate of claim 4, wherein the metal magnetic powder contains iron (Fe) as a main component and contains silicon (Si) or chromium (Cr).

6. The coil-embedded integrated circuit substrate of claim 1, wherein the filling material contains a magnetic resin composition including a mixture of a ferrite powder and a resin.

7. The coil-embedded integrated circuit substrate of claim 1, wherein the filling material contains a resin.

8. The coil-embedded integrated circuit substrate of claim 1, further comprising:

a via formed by filling a via hole penetrating through one of the upper insulating layer or the lower insulating layer with a conductive material; and circuit patterns on the one of the upper insulating layer or the lower insulating layer connected to the via.

9. The coil-embedded integrated circuit substrate of claim 8, wherein the coil is connected to the circuit patterns formed on the one of the upper insulating layer or the lower insulating layer by plating or soldering through the via hole, and the coil is connected to the circuit patterns in at least one direction of upward and downward directions of the filling material in which the coil is embedded.

10. The coil-embedded integrated circuit substrate of claim 1, wherein the coil-embedded integrated circuit substrate is a substrate having an embedded power inductor for a power management integrated circuit (PMIC).

* * * * *